US005961034A

United States Patent [19]

deMunnik et al.

[11] Patent Number: 5,961,034

[45] Date of Patent: Oct. 5, 1999

[54] CLOTH BOX SLEEVE

[76] Inventors: Mary deMunnik; Brian D. deMunnik, both of 1610 Wagon Wheel, Pantego, Tarrant County, Tex. 76013

[21] Appl. No.: 09/115,416

[22] Filed: Jul. 14, 1998

Related U.S. Application Data

[60] Division of application No. 08/692,809, Jul. 30, 1996, Pat. No. 5,795,282, which is a continuation-in-part of application No. 08/525,957, Sep. 8, 1995, abandoned.

[51] Int. Cl.[6] ..... B65D 65/10; B65D 30/04; B65D 30/18; B65D 33/24

[52] U.S. Cl. ..... 229/87.19; 383/104; 383/107; 383/121; 383/122

[58] Field of Search ..... 229/87.18, 87.19, 229/923, 116.5; 383/104, 121, 107, 122

[56] References Cited

U.S. PATENT DOCUMENTS

| | | | |
|---|---|---|---|
| 260,820 | 7/1882 | Arkell . | |
| 274,736 | 3/1883 | Detrick . | |
| 279,587 | 6/1883 | Onderdonk | 383/122 |
| 490,103 | 1/1893 | Collins . | |
| 529,690 | 11/1894 | Arkett et al. . | |
| 670,360 | 3/1901 | Lawler . | |
| 723,282 | 3/1903 | Jessen et al. . | |
| 804,747 | 11/1905 | MacKenzie | 383/107 |
| 815,255 | 3/1906 | Bell . | |
| 1,018,628 | 2/1912 | Mortenson . | |
| 1,126,341 | 1/1915 | Baer . | |
| 1,291,480 | 1/1919 | Gore . | |
| 1,636,495 | 7/1927 | Widmaier . | |
| 1,749,005 | 3/1930 | Taylor | 383/122 |
| 1,841,891 | 1/1932 | Hardy | 383/122 |
| 1,951,604 | 3/1934 | Friedlander | 150/52 |
| 2,399,973 | 5/1946 | Albin | 112/262 |
| 2,551,044 | 5/1951 | Ottinger et al. | 150/11 |
| 2,605,803 | 8/1952 | Fletchner | 150/52 |
| 3,079,844 | 3/1963 | Kugler | 93/35 |
| 3,099,237 | 7/1963 | Currin et al. | 112/262 |
| 3,550,662 | 12/1970 | Remke et al. | 150/11 |
| 3,826,296 | 7/1974 | Morris | 150/3 |
| 4,005,814 | 2/1977 | Foster | 229/39 R |
| 4,193,152 | 3/1980 | Seibold, Jr. | 5/490 |
| 4,742,788 | 5/1988 | Dugan | 112/262.1 |
| 4,822,178 | 4/1989 | Taylor | 383/33 |
| 4,967,952 | 11/1990 | Roessiger | 229/87.19 |
| 5,047,001 | 9/1991 | Willis | 493/267 |
| 5,062,717 | 11/1991 | Shockley | 383/20 |
| 5,238,307 | 8/1993 | Mooney et al. | 383/74 |
| 5,407,125 | 4/1995 | Yates et al. | 229/923 |

FOREIGN PATENT DOCUMENTS

| | | | |
|---|---|---|---|
| 4300891 | 1/1993 | Germany | 88/16 |

*Primary Examiner*—Stephen P. Garbe
*Attorney, Agent, or Firm*—Baker & Botts, L.L.P.

[57] ABSTRACT

The cloth box sleeve (110) and its method of construction are disclosed. The cloth box sleeve (110) is a single piece of fabric (10) having a top edge (971), two side edges (73), (75) and a bottom edge (70). There is a fold line (72) in the center of fabric piece (10) separating the two side edges (73), (75). The fabric piece (10) is folded along the fold line (72). Two quarter sections (77), (79) are cut adjacent both side edges (73), (75) and bottom edge (70). A half section (81) is cut along the bottom edge (70) between the side edges (73), (75) adjacent the fold line (72). There is a first seam (83) fastening the two side edges together and a second seam (85) along bottom edge (80) fastening two halves of the bottom edge together. An opening dimensioned along the top edge to receive a box. The opening has upper and lower flaps (118) and (124) along the top edge (116) with a closure (120), (126) for sealing the cloth box sleeve (110).

27 Claims, 9 Drawing Sheets

CLOTH BOX SLEEVE

CROSS-REFERENCE TO RELATED APPLICATIONS

This application is a divisional of U.S. application Ser. No. 08/692,809, filed Jul. 30, 1996, now U.S. Pat. No. 5,795,282; which is a continuation-in-part of U.S. application Ser. No. 08/525,957, filed Sep. 8, 1995, now abandoned.

TECHNICAL FIELD OF THE INVENTION

This invention relates generally to the field of box wrappers and more particularly to a cloth box sleeve and its method of construction.

BACKGROUND OF THE INVENTION

Most box wrapping is performed using paper which is folded and taped or sealed along the edges. Paper is the predominant material because it is a relatively inexpensive and pliable material. Since almost every paper wrapped box is custom fitted, there is oftentimes a high percentage of waste in the cutting step used to fashion the paper wrapper. While paper wrapping is used extensively, it has a number of disadvantages. Aside from the waste in the initial cutting of the wrapper, paper wrapping is difficult to reuse once the box is unwrapped. Another disadvantage of paper wrapping is that it rips or tears easily and lacks durability. Another disadvantage is that wrapping a box in paper requires a number of steps and is therefore labor intensive making it expensive to perform by retailers and other merchants who wish to wrap boxes during the holiday season and for special occasions.

In an effort to overcome these disadvantages, various efforts have been undertaken to create reusable box wrappers. One such effort is described in U.S. Pat. No. 1,291,480. The method disclosed in that patent describes using a single piece of fabric with fasteners arranged at one end. One disadvantage of the method disclosed in this patent is that the fabric wrapper is essentially a sack without any provision for squaring all four corner edges. Another disadvantage of this approach is that no details are provided for constructing the box wrapper in a way to minimize scrap material or to dimension the pattern to accommodate varying box sizes. Another disadvantage of this method is that it does not permit for tight fitting side edges and is not designed for automated construction.

Therefore, a need has arisen for a new cloth box sleeve and its method of construction that overcomes the disadvantages and deficiencies of the prior art.

SUMMARY OF THE INVENTION

A cloth box sleeve is disclosed. In one embodiment the cloth box sleeve is a single piece of fabric having a top edge, two side edges and a bottom edge. There is a fold line in the center of the fabric separating the two side edges. The fabric piece is folded along the fold line. Two quarter sections are cut adjacent both side edges and the bottom edge and a half section is cut along the bottom edge between the two side edges adjacent the fold line. There is a first seam fastening the two side edges together and a second seam along the bottom edge fastening two halves of the bottom edge together. An opening is dimensioned along the top edge to receive a box. The opening has upper and lower flaps along the top edge with a closure for sealing the cloth box sleeve.

In another embodiment, the cloth box sleeve is a single piece of fabric having a top edge, two side edges, and a bottom edge. There is a fold line in the center of the fabric separating the top and bottom edges. The fabric piece is folded along the fold line. Two half sections are cut along the side edges adjacent the fold line. There is a first seam fastening two halves of one side edge together and a second seam fastening two halves of the other side edge together. An opening is dimensioned along the top edge to receive a box. The opening has upper and lower flaps along the top edge with a closure for sealing the cloth box sleeve.

In another embodiment, the method for constructing a cloth box sleeve in accordance with the invention comprises 7 steps. Those steps are patterning a single piece of fabric to have a top edge, two side edges and a bottom edge; drawing a fold line in the center of the fabric piece to form first and second halves where each half includes at least one side edge and half the bottom edge; removing a portion of the fabric along both side edges and the bottom edge; removing a portion of the fabric along the bottom edge adjacent the fold line; sewing the side edges together; sewing the two halves of the bottom edge together; and constructing a closure along the top edge.

In another embodiment, the method for constructing a cloth box sleeve in accordance with the invention comprises 5 steps. Those steps are patterning a single piece of fabric to have a top edge, two side edges and a bottom edge; forming a fold line in the center of the fabric piece to form first and second halves where each half includes at least one side edge and half the bottom edge; fastening a top seam, a side seam and a bottom seam; folding excess material between the bottom seam and a box to create fitted corners, and constructing a closure along the top edge.

A technical advantage of the present invention is that a cloth box sleeve is provided avoiding the need for custom paper wrapping. Another technical advantage is that the invention provides a relationship between the overall dimensions of the sleeve to provide a seam allowance. Another technical advantage is that a box sleeve is provided that is easy to assemble and is reusable. Another technical advantage is that a cloth box sleeve is provided that resembles a conventional gift wrapper with the look of paper, but has the strength of cloth. Another technical advantage of this invention is that it reduces time spent wrapping a box and there are no additional components needed to complete the wrapping. Another technical advantage of this invention is that a closure is provided that is reusable. Another technical advantage is that a method of constructing a cloth box sleeve is provided that is readily capable of use in an automated process. Another technical advantage is that a method of construction is provided that minimizes the amount of scrap. Another technical advantage arises in mass production assembly, where the continuation of cuts and number of steps used to make a finished product is minimized resulting in a time efficient pattern for sewers.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE INVENTION

The preferred embodiment of the present invention and its advantages are best understood by referring to FIGS. 1 through 12 of the drawings, like numerals being used for like and corresponding parts of the various drawings.

Figure 1:
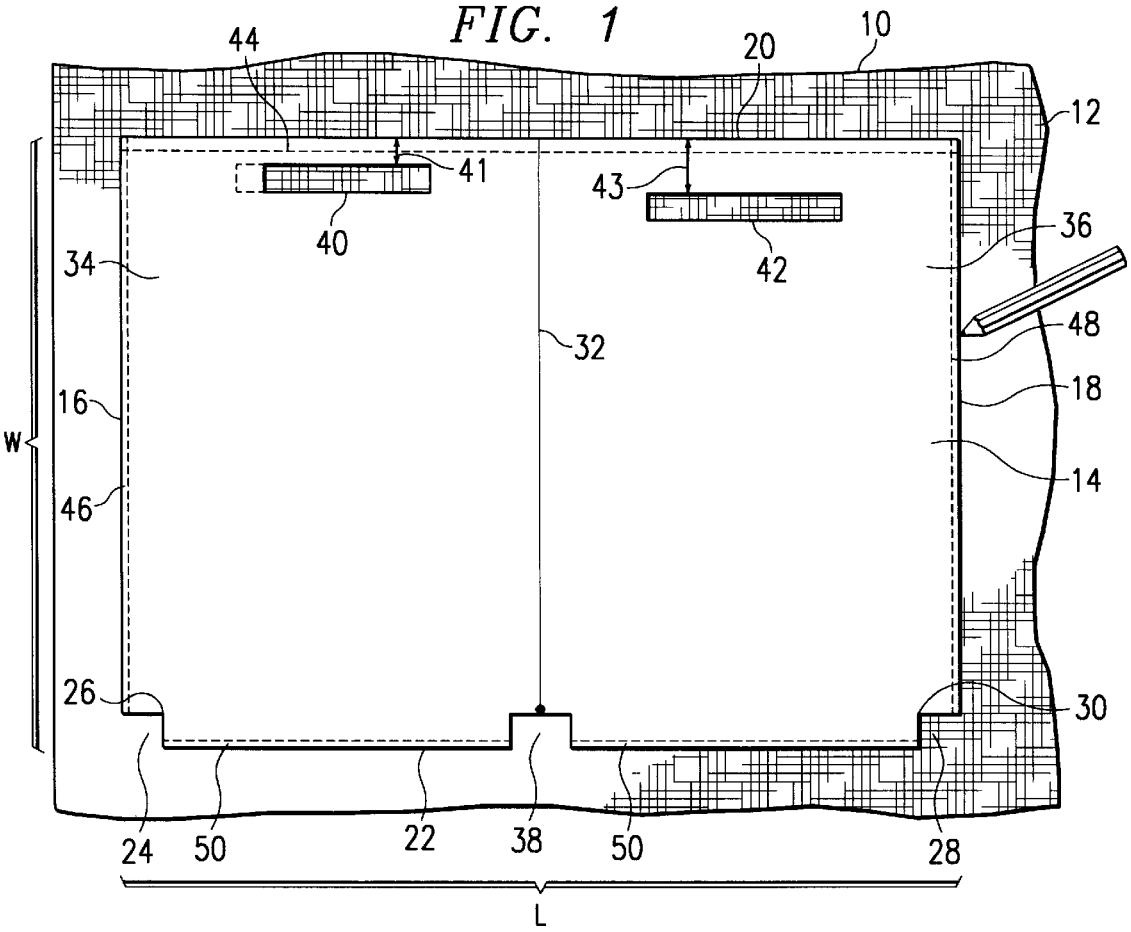
FIGS. 1 illustrates the use of a pattern for practicing the invention.

Referring to FIG. 1, the patterning of the single piece of fabric is illustrated. Fabric 10 can be any type of cloth suitable for wrapping a box or other packaging. In the preferred embodiment, fabric 10 is lightweight cotton cloth with a design printed on printed surface 12 leaving the other side (not shown) blank. Pattern 14, constructed out of suitable material such as cardboard, is used to lay out the pattern for the box sleeve. Pattern 14 has two side edges 16 and 18, a top edge 20, and a bottom edge 22. Along the side edge 16, also referred to as left edge 16, and bottom edge 22 there is a cut out portion 24 at bottom left corner 26. Similarly, along edge 18, also referred to as right edge 18, and bottom edge 22 there is a side seam corner or cut out portion 28 located at bottom right corner 30 of pattern 14. In the center of pattern 14 there is fold line 32 that separates pattern 14 into left half 34 and right half 36. Adjacent fold line 32, along bottom edge 22, is a fold seam corner or half cut portion 38.

Proximate top edge 20 there are two windows 40 and 42 used for patterning the closure. In the preferred embodiment, window 40 is positioned nearer top edge 20 than window 42 to allow for the folding in the final construction. Pattern 14 is drawn with various seam allowances to provide extra cloth to form seams along the edges of the cloth box. The top seam allowance 44 can be dimensioned to allow for a drawstring (not shown). In the preferred embodiment, side edge seam allowances 46 and 48 and bottom seam allowance 50 are the same width.

Figure 8:
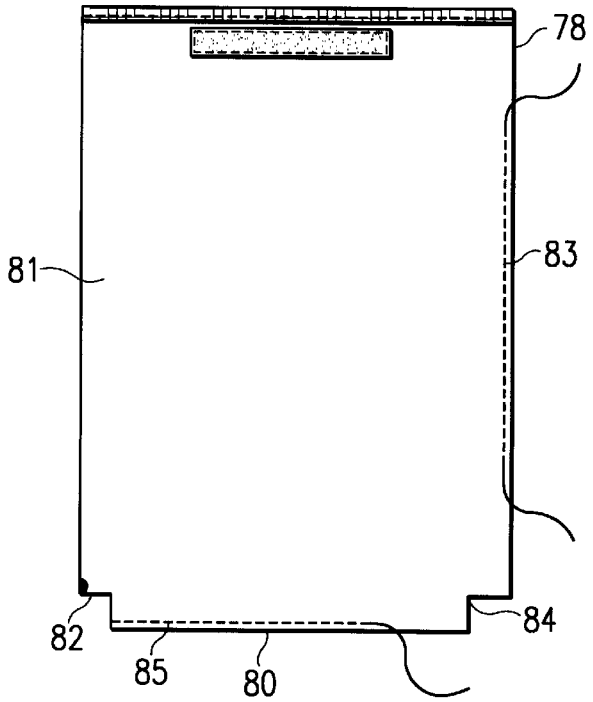
FIG. 8 illustrates how the fabric edges are joined.

After fabric 10 has the outline of pattern 14 drawn on the right side of cloth or its printed surface 12, the fabric is cut so that it matches pattern 14. In the next step, the closure is patterned as illustrated in FIGS. 2–6. It should be noted that closure positions 52 and 54 are patterned on different faces of fabric 10. One closure position is patterned on printed surface 12 while the other closure position is patterned on the wrong side of cloth or blank surface 81 (FIG. 8).

Figure 2:
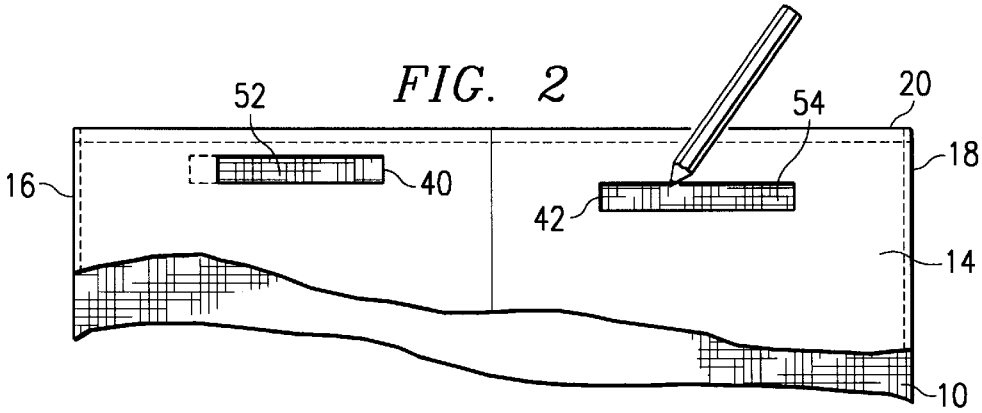
FIG. 2 illustrates the method of patterning a first closure half for use with the invention on one side of the fabric.
Figure 3:
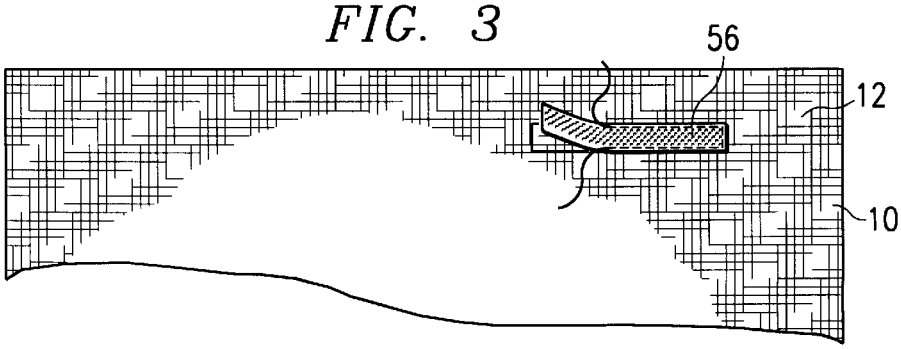
FIG. 3 illustrates a method of installing the first closure half on a side of the fabric.

Referring to FIG. 2, pattern 14 is aligned with fabric 10 on surface 12 so that the top edge 20 of pattern 14 aligns with the top edge 71 (FIG. 7) of fabric 10. Similarly the side edges 16 and 18 of pattern 14 align with the side edges 73 and 75 (FIG. 7) of fabric 10. Once pattern 14 is aligned with fabric 10, closure position 54 is patterned on surface 12 using window 42. Windows 40 and 42 are positioned below top edge 20 using the grading formulas described below. In the preferred embodiment, window 40 patterns the loop material and is positioned below top edge 20 by a distance 41 while windows 42 patterns the hook material and is positioned below top edge 20 by a distance 43. Once closure position 54 is patterned, pattern 14 is removed and closure 56, shown in FIG. 3, is fastened to fabric 10. Closure 56 can be fastened to fabric 10 using conventional sewing methods or in the alternative it can be fastened using adhesives known to those skilled in the art. In the preferred embodiment, closure 56 will be either the hook or loop type fastener sold by velcro. Either the hook or the loop material will be fastened to closure position 54 and the complimentary hook or loop material will be fixed to closure position 52. It should be understood that fastener 56 will be fixed to printed surface 12 of fabric 10 while the complimentary fastener will be fixed to blank surface 81 on the opposite side of fabric 10 as illustrated in FIGS. 4 and 5.

Figure 4:
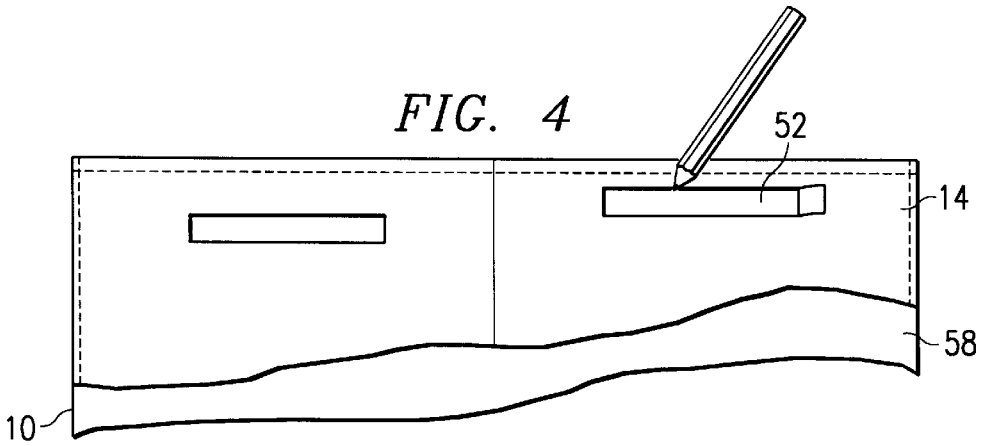
FIG. 4 illustrates the method of patterning a second closure half for use with the invention on a second side of the fabric.
Figure 5:
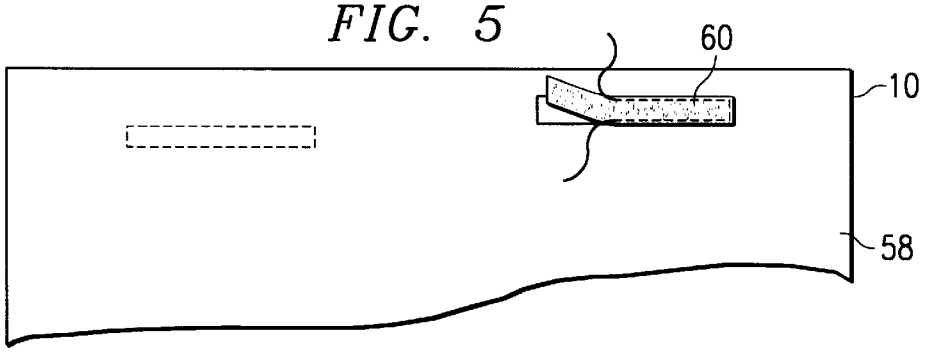
FIG. 5 illustrates a method of installing the second closure half on a second side of the fabric.

Referring to FIG. 4, pattern 14 is shown aligned on the reverse side 58 of fabric 10. The edges 16, 18 and 20 are aligned with the edges of fabric 10 as explained in connection with FIG. 2 to properly lay out closure position 52. Once closure position 52 has been properly laid out on fabric 10, pattern 14 is removed and complimentary closure 60 is secured to the reverse side 58 of fabric 10 as shown in FIG. 5. While the preferred embodiment has been described in connection with a hook and loop style fastener, alternative fasteners such as buttons, snaps, zippers, etc., are known to those skilled in the art and can be used as closures in this invention.

Figure 6A:
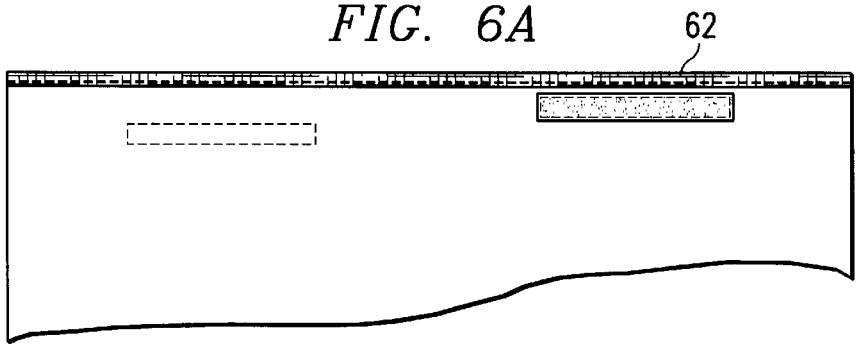
FIGS. 6A and 6B illustrate how an edge is seamed.
Figure 6B:
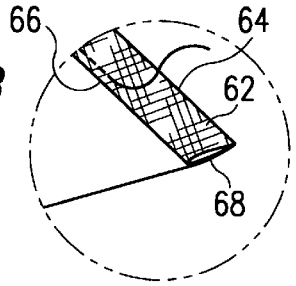

Referring now to FIGS. 6A and 6B, the construction of seam 62 is illustrated. As shown in FIG. 6B, seam 62 is constructed by folding fabric 14 at seam lines 64 and 66. Seam 62 is provided to allow for a clean edge along the top of the cloth box sleeve. In one embodiment, seam 62 is constructed large enough to allow for the insertion of a string or cord that will act as a closure. As shown in FIG. 6B, opening 68 is suitable for a pull-type string closure.

In laying out the various seams and placing the closures, various grading formulas have been derived. The width W of pattern 14 (shown in FIG. 1) is calculated by the formula: W=bottom seam allowance 50+(1.5×d)+l+top seam allowance 44; where d is the box depth (shown in FIG. 11) and l is the box length (shown in FIG. 11). The length L of the pattern, shown in FIG. 1, is calculated by the formula: 2×(side seam allowance 46,48+1.075×d+w); where w is the box width (shown in FIG. 11). The length of the hook and loop style fastener is determined by the formula: w−2×(d−0.25")−0.25". The placement of the loop material 41 is determined by the formula: 0.5"+top seam allowance 44. The placement of the hook material 43 is determined by the formula: d−(fastener width+0.5)+top seam allowance 44. The horizontal and vertical sides of side corners 24 and 28 and vertical sides of fold seam corner 38 are derived by the formula: d/2−0.25"+(side seam allowance 46, 48 or bottom seam allowance 50). The horizontal side of fold seam corner 38 is derived by the formula d−0.5". Using these grading formulas, a cloth box sleeve can be laid out for any size box in an efficient and effective manner. Examples illustrating the use of these formulas are set out in the following table.

| BOX DIMENSIONS | PATTERN WIDTH | PATTERN LENGTH | CLOSURE LENGTH | LOOP PLACEMENT | HOOK PLACEMENT | HORIZONTAL SIDE OF FOLD SEAM HALF CUT | VERTICAL AND HORIZONTAL SIDES OF SIDE SEAM CORNER CUT |
|---|---|---|---|---|---|---|---|
| Robe Box Box depth = 2.5" Box Length = 17" Box width= 11" | 21.5" | 27.875" | 6.25" | 1.0" | 1.75" | 2.0" | 1.25" |
| Shirt Box Box depth = 2" Box length = 15" Box width = 9.5" | 18.75" | 23.8" | 5.75" | 1.0" | 1.25" | 1.5" | 1.0" |
| Lingerie Box Box depth = 1.625" Box length = 11.5" Box width = 8.5" | 14.6875" | 20.99375" | 5.5" | 1.0" | 0.875" | 1.125" | 0.8125" |

Figure 7:
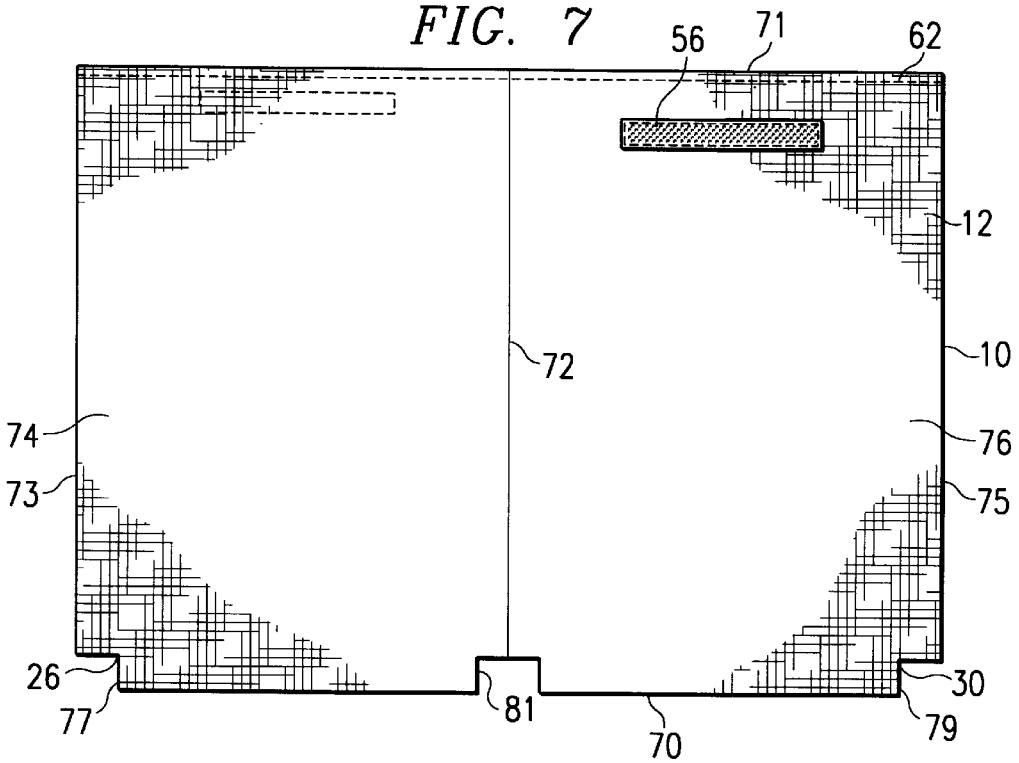
FIG. 7 is the patterned fabric prior to joining the edges together.

Referring now to FIG. 7, closures 56 and 60 having been installed and seam 62 having been completed, the final construction of the cloth box sleeve can be undertaken. A portion of fabric 10 has been removed at corners 26 and 30. In accordance with the preferred invention, a quarter section has been removed from each corner as outlined by pattern 14. Bottom edge 70 of fabric 10 at fold line 72 has a half-section of the fabric removed to facilitate construction of a sharp corner. Left side 74 of fabric 10 is folded over onto the right side of fabric 76 with the design faces of surface 12 touching one another.

As shown in FIG. 8, the two side edges are sewn together at 78 and the two bottom edges are sewn together at 80. In the preferred embodiment, the sewing is performed using a straight stitch. Once the side edges have been sewn together and the bottom edges sewn together, left corner 82 and right corner 84 need to be sewn.

Figure 9A:
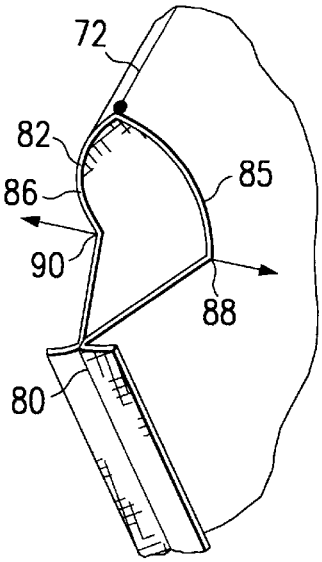
FIGS. 9A and 9B illustrate how the left corner is formed.
Figure 9B:
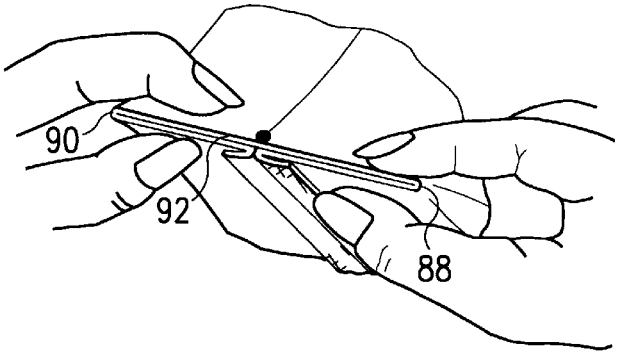

Referring to FIG. 9A and 9B, right corner 82 which is located along fold line 72 and bottom edge 80 has two sides 85 and 86. To construct the box sleeve with a sharp corner to provide no bulging at the corner edges, sides 86 and 85 need to be separated in the direction of the arrows as shown. This causes the edges 85 and 86 to fold at points 88 and 90. As shown in FIG. 9B, left corner edge 92 is now prepared to be sewn.

Figure 10A:
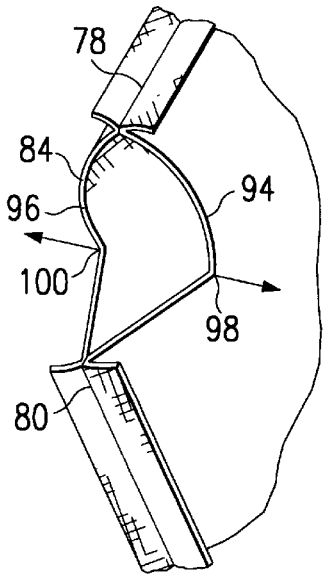
FIGS. 10A and 10B illustrate how the right corner is formed.
Figure 10B:
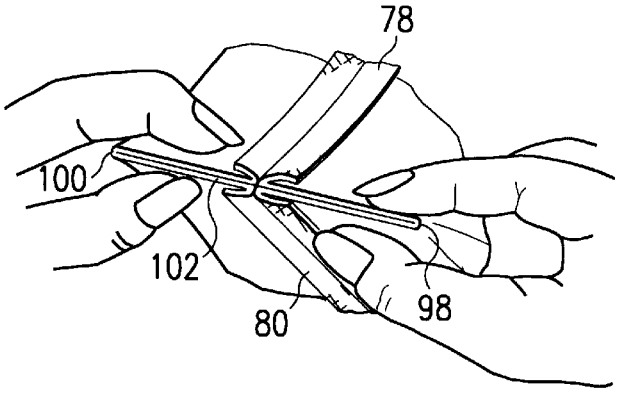

Now referring to FIGS. 10A and 10B, a left corner 84 adjacent to bottom edge 80 and side edge 78 is constructed similar to right corner 82. Sides 94 and 96 are separated in the direction of the arrows as shown to create a fold at points 98 and 100 forming corner edge 102 shown in FIG. 10B. Corner edges 92 and 102 can be sewn in the same manner as bottom edge 80 and side edges 78. In the preferred embodiment a straight stitch is used. Once corner edges 92 and 102 have been sewn, the box sleeve is inverted so that the surface 12 will be exposed.

Figure 11:
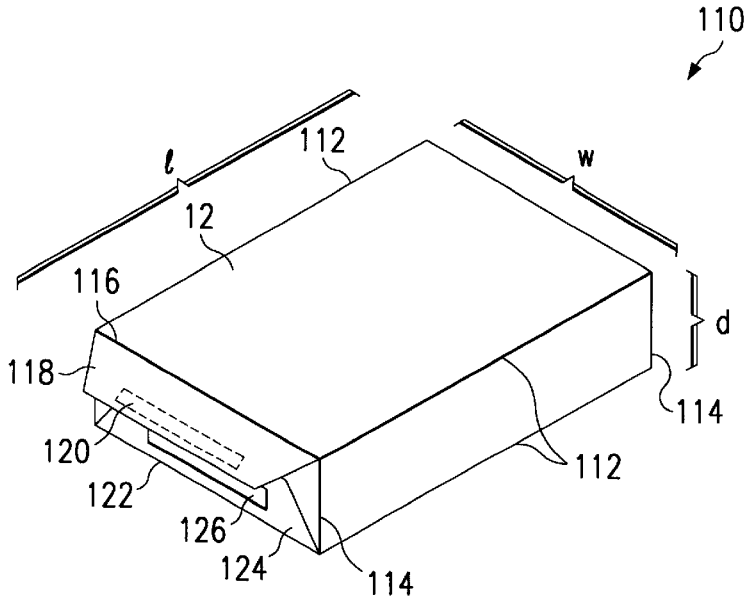
FIG. 11 shows a cloth box sleeve constructed in accordance with the invention.

As shown in FIG. 11, box sleeve 110 is formed with straight edges 112 and flush corners 114 to provide a sharp appearance. Also shown in FIG. 11, box 110 has an opening dimensioned to receive a box. Top edge 116 has upper flap 118 with a closure fastened on the inside of flap 118. Along bottom edge 122 is flap 124 with a complimentary closure affixed to flap 122. Closures 126 and 120 when pressed together will form a tight, secure seal of the contents of box sleeve 110.

Figure 12:
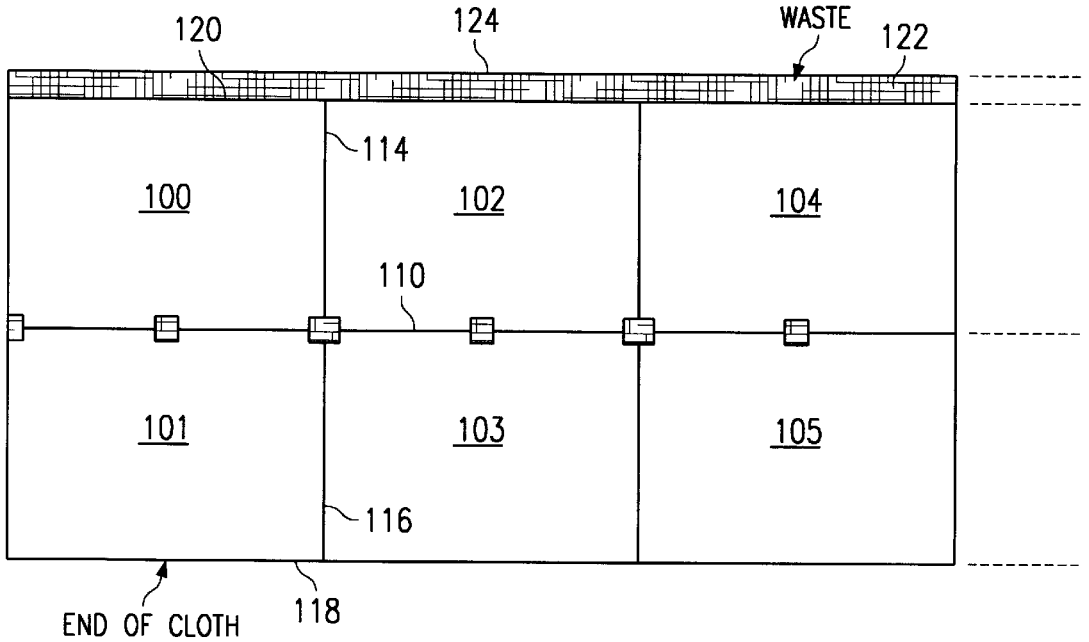
FIG. 12 is a layout for use in connection with the construction of a cloth box sleeve in accordance with the invention.

Referring to FIG. 12, a layout is shown for automating the production of cloth box sleeves in accordance with the invention. Box sleeves 100, 101, 102, 103, 104, and 105 are patterned on cloth bolt 106. Each of box sleeves 100, 102 and 104 share common bottom edges 108, 110 and 112. Similarly, box sleeves 100 and 101 share common side edges 114 and 116 with box sleeves 102 and 103. Bottom edge 118 is aligned with the edge of the cloth so no cut is required. Upper edge 120 leaves waste 122 along bolt edge 124. By use of the common edges, there is no waste between cuts. In the preferred embodiment, an electric knife is used on multiple layers of cloth.

Another embodiment of the present invention and its advantages are best understood by referring to FIGS. 13 through 17 of the drawings, like numerals being used for like and corresponding parts of the various drawings.

Figure 13:
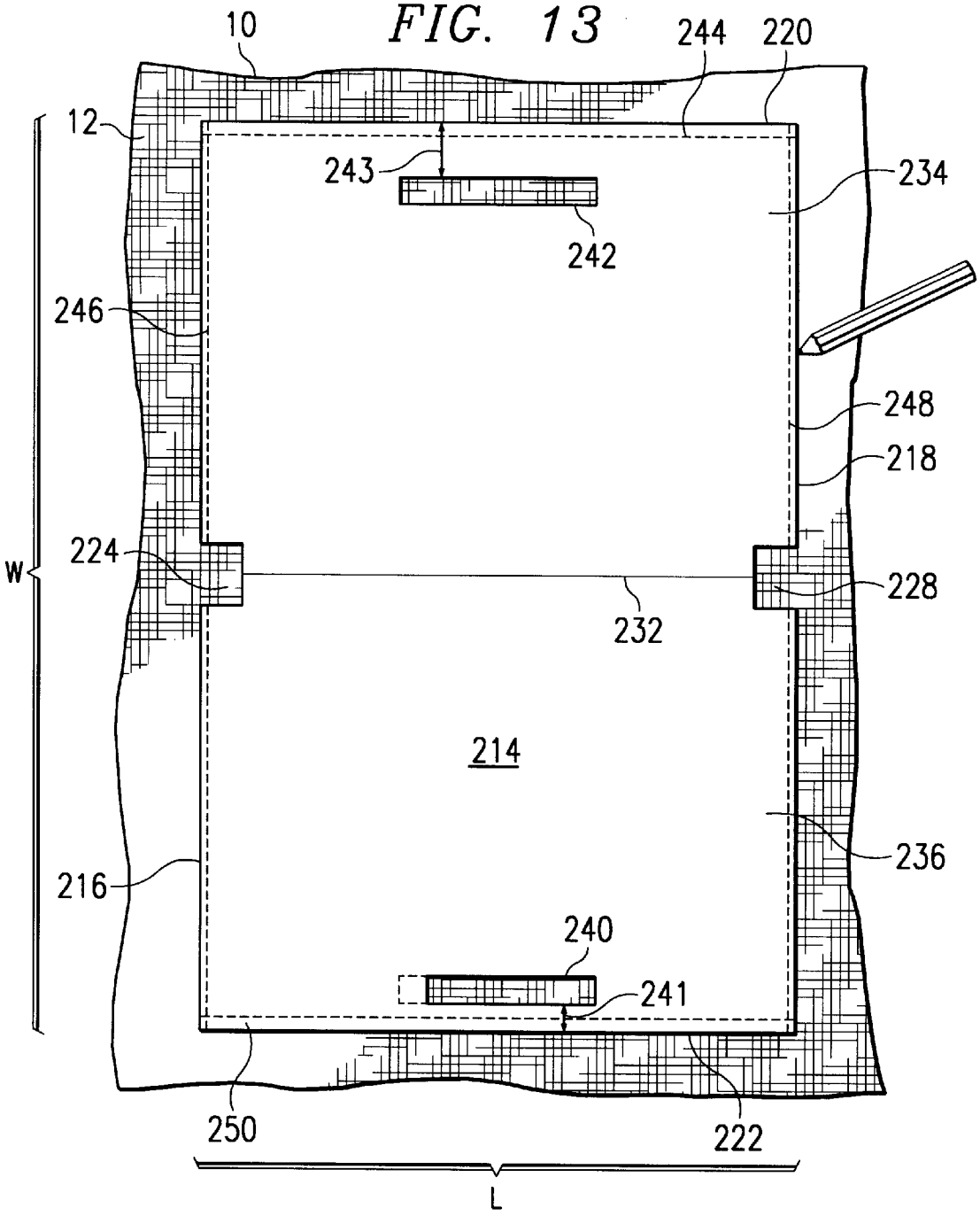
FIG. 13 illustrates the use of a second pattern for practicing the invention.

Referring to FIG. 13, a second patterning of a single piece of fabric is illustrated. In the center of pattern 214, a fold line 232 is formed that separates pattern 214 into upper half 234 and lower half 236. Along the side edge 216, also referred to as left edge 216, there is a cut out portion 224 located adjacent the fold seam. Similarly, along side edge 218, also referred to as right edge 218, there is a cut out portion 228 located adjacent the fold seam. Approximate bottom edge 222 there is a window 240 used for patterning the closure and approximate top edge 220 there is a window 242 also used for patterning the closure. In this embodiment, window 240 is positioned nearer bottom edge 222 than window 242 is positioned to top edge 220 to allow for folding in the final construction. The top seam allowance 244 and bottom seam allowance 250 can be dimensioned to allow for a drawstring (not shown). Side edge seam allowances 246 and 248 and bottom seam allowance 250 are not necessarily all of the same width. The fabric 10 has the outline drawn and is cut in a similar manner to that described above for the pattern shown in FIG. 1. The closures are also patterned as described above.

Figure 14:
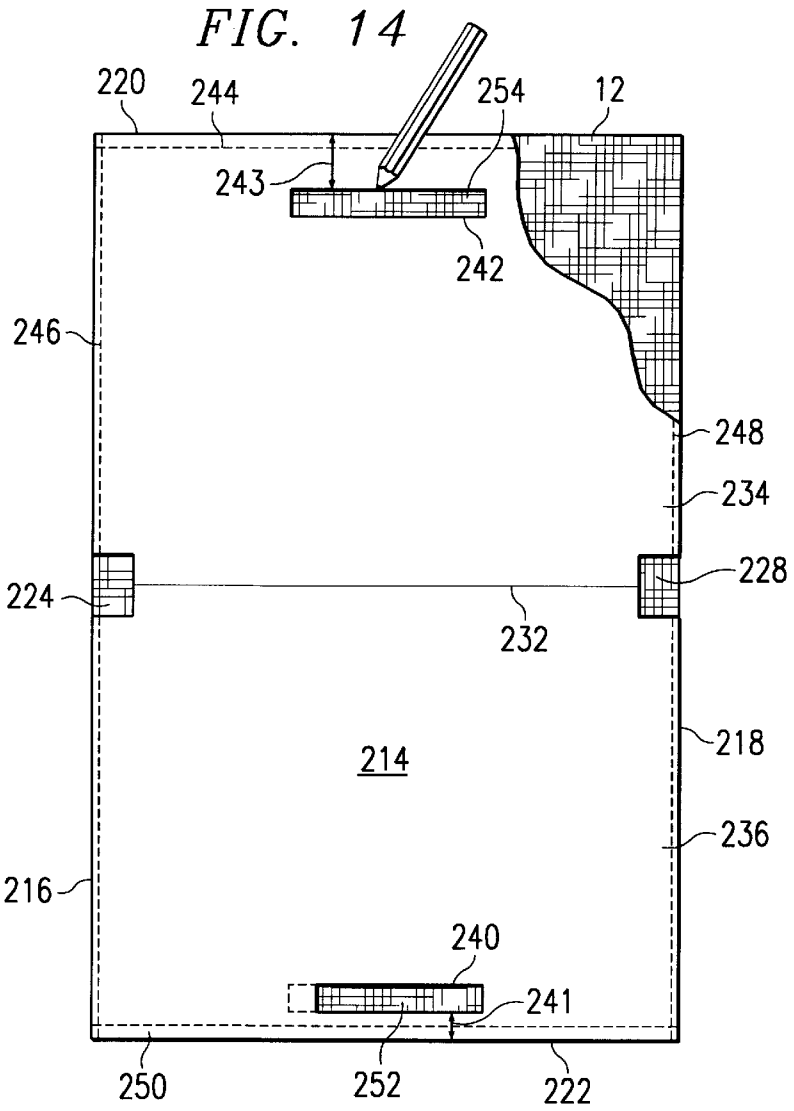
FIG. 14 illustrates the method of patterning a first closure half for use with the invention on one side of the fabric for use with the pattern shown in FIG. 13.

Referring to FIG. 14, pattern 214 is aligned with fabric 10 on surface 12 so that the top edge 220 of pattern 214 aligns with the top edge 271 (FIG. 16) of fabric 10. Similarly the side edges 216 and 218 of pattern 214 align with the side edges 273 and 275 (FIG. 16) of fabric 10. Once pattern 214 is aligned with fabric 10, closure position 254 is patterned on surface 12 using window 242. Window 242 is positioned below top edge 220 and window 240 is positioned above bottom edge 222 using the grading formulas described below. In this embodiment, window 240 patterns the loop material and is positioned above bottom edge 220 by a distance 241 while window 242 patterns the hook material and is positioned below top edge 220 by a distance 243. Once closure position 254 is patterned, pattern 214 is removed and closure 256 is fastened to fabric 10 by one of the various methods disclosed above and as shown in FIG. 3.

Figure 15:
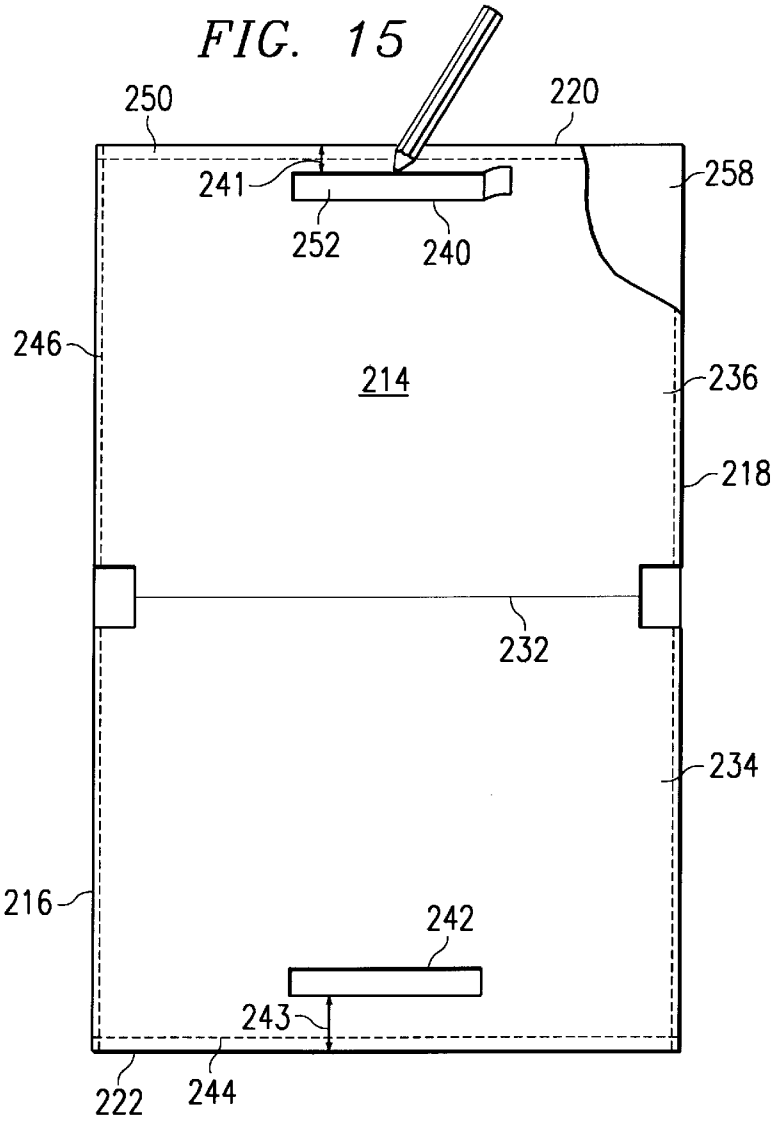
FIG. 15 illustrates the method of patterning a second closure half on a second side of the fabric for the pattern shown in FIG. 13.

Referring to FIG. 15, pattern 214 is shown aligned on the reverse side 258 of fabric 10. The edges 216, 218 and 222 are aligned with the edges of fabric 10 as explained in connection with FIG. 14 to properly lay out closure position 252. Once closure position 252 has been properly laid out on fabric 10, pattern 214 is removed and complimentary closure 260 is secured to the reverse side 258 of fabric 10 in the same manner as shown in FIG. 5.

Figure 16:
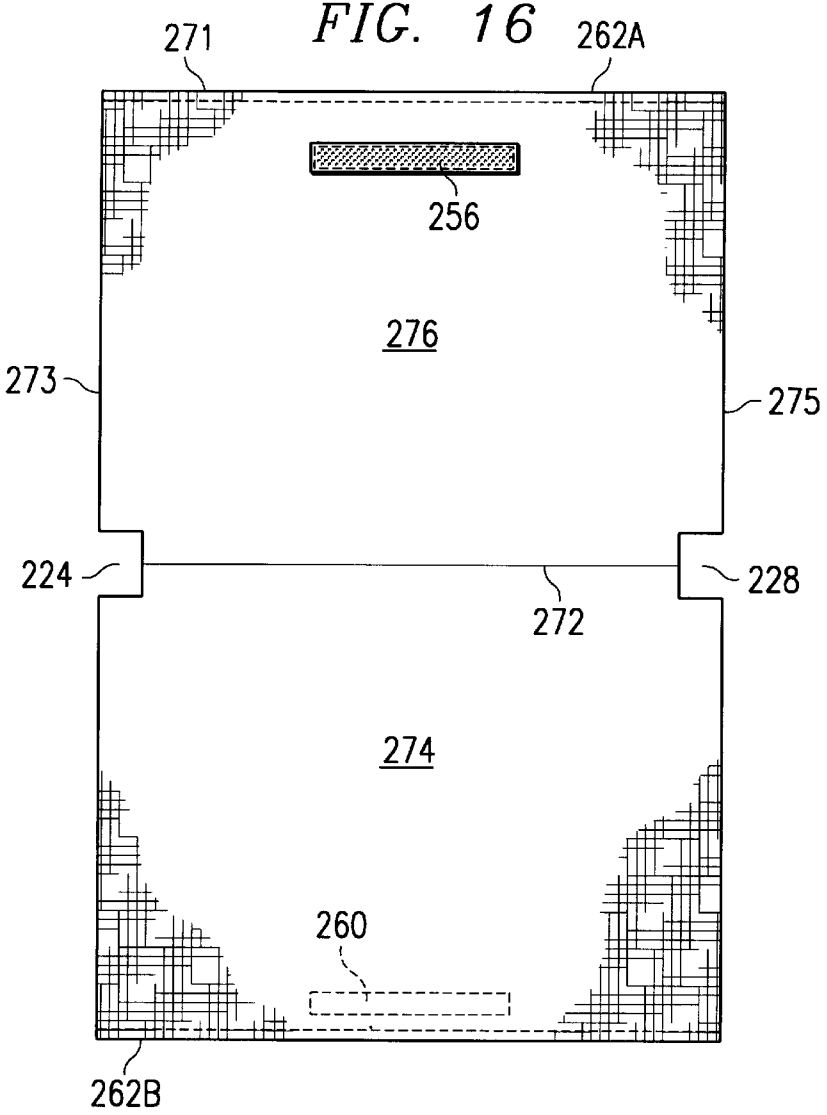
FIG. 16 is the patterned fabric of FIG. 13 prior to joining the edges together.

Referring to FIG. 16, a seam 262A is constructed along top edge 220 and a seam 262B is constructed along bottom edge 222. Construction of both seams is performed in the same manner as shown in FIG. 6A and 6B. Seams 262A and 262B are provided to allow for a clean edge along the top of the cloth box sleeve. In one embodiment, seam 262A and 262B are constructed large enough to allow for the insertion of a string or cord that will act as a closure.

In laying out the various seams and placing the closures, various grading formulas have been derived. The width W of pattern 214 (shown in FIG. 13) is calculated by the formula: W=bottom seam allowance 250+(1.5×d)+2×l+top seam allowance 244; where d is the box depth (shown in FIG. 11) and 1 is the box length (shown in FIG. 11). The length L of the pattern, shown in FIG. 13, is calculated by the formula: 2×(side seam allowance 246,248)+1.15×d+w); where w is the box width (shown in FIG. 11). The length of the hook and loop style fastener is determined by the formula: w−2×(d−0.25")−0.25". The placement of the loop material 241 is determined by the formula top seam allowance 244+0.5. The placement of the hook material 243 is determined by the formula: d−(fastener width+0.5)+top seam allowance 244. The horizontal dimension of the half cut-out portions along the fold seam line are determined by the formula: d/2−0.25+side seam allowance 246, 248. The vertical dimension of the half cut-out portions along the fold seam line are determined by the formula: d−0.5". Using these grading formulas, a cloth box sleeve can be laid out for any size box in an efficient and effective manner. Examples illustrating the use of these formulas are set out in the following table.

| BOX DIMENSIONS | PATTERN WIDTH | PATTERN LENGTH | CLOSURE LENGTH | LOOP PLACE-MENT | HOOK PLACEMENT | VERTICAL SIDE OF FOLD SEAM HALF CUT | HORIZONTAL SIDES OF FOLD SEAM HALF CUT |
|---|---|---|---|---|---|---|---|
| Robe Box Box depth = 2.5" Box Length = 17" Box width = 11" | 38.5" | 14.375" | 6.25" | 1.0" | 1.75" | 2.0" | 1.25" |
| Shirt Box Box depth = 2" Box length =15" Box width 9.5" | 33.75" | 12.3" | 5.75" | 1.0" | 1.25" | 1.5" | 1.0" |
| Lingerie Box Box depth = 1.625" Box length = 11.5" Box width = 8.5" | 26.1875" | 10.86875" | 5.5" | 1.0" | 0.875" | 1.125" | 0.8125" |

Referring now to FIG. 16, closures 256 and 260 having been installed and seams 262A and 262B having been completed, the final construction of the cloth box sleeve can be undertaken. A portion of fabric 10 has been removed at mid-sections 224 and 228. In accordance with the preferred form of this embodiment, a half section has been removed at each side of the fold seam 272 as outlined by pattern 214. Lower half 274 of fabric 10 is folded over onto the upper half 276 of fabric 10 with the design faces of surface 12 touching one another.

Figure 17:
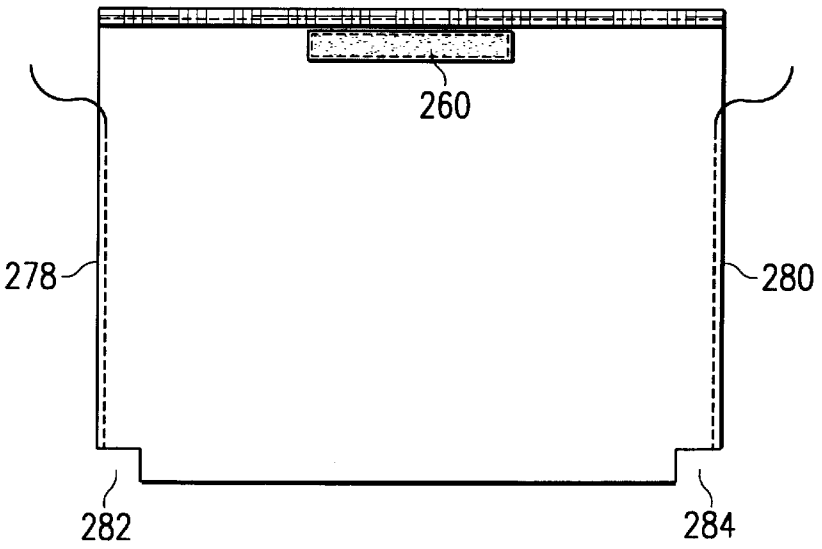
FIG. 17 illustrates how the fabric edges formed from the pattern in FIG. 13 are joined.

As shown in FIG. 17, the lower and upper halves of the left side are sewn or glued together at 278 and the lower and upper halves of the right side are sewn or glued together at 280. Once the side edges have been fastened by being sewn or glued together, left corner 282 and right corner 284 need to be fastened together. This is accomplished in the same manner as corners 82 and 84 were fastened, as shown in FIGS. 9 and 10. Box sleeve 110 is thus formed as shown in FIG. 11. While in the preferred embodiment, the halves are fastened by either sewing or gluing, it should be understood that other means of fastening are within the scope of the present invention.

In another embodiment, the method for constructing a cloth box sleeve in accordance with the invention comprises 5 steps. Those steps are patterning a single piece of fabric to have a top edge, two side edges and a bottom edge; forming a fold line in the center of the fabric piece to form first and second halves where each half includes at least one side edge and half the bottom edge; fastening a top seam, a side seam and a bottom seam; folding excess material between the bottom seam and a box to create fitted corners, and constructing a closure along the top edge. Instead of sewing the edges and corners, the seams may be formed through a heat seal. This embodiment uses the pattern as shown in FIG. 1 except that no corner or half cutouts are made in the fabric.

A single piece of fabric is patterned as explained in connection with FIG. 1, except that no corner cuts or half cuts are made. Closure positions 52 and 54 are patterned as discussed and shown in FIG. 2 and 4. Closures 56 and 60 are fastened to fabric 10 as shown in FIGS. 3 and 5 except that instead of using conventional sewing methods a glue gun is used to attach the closures. Seam 62 is constructed as discussed and shown in FIGS. 6A and 6B except instead of sewing with a straight seam, heat bond tape with application of a hot iron is used to fasten seam 62.

The two side edges are sealed together at 78, forming a seam, and the two bottom edges are sealed together at 80, forming a seam. This is shown in FIG. 8, except that the corner cut-outs are not present in this embodiment. In the preferred mode of this embodiment, the seal is a heat seal using heat bond hem tape and application of a hot iron. Once the two side edges and two bottom edges are sealed, the box sleeve is inverted so that surface 12 will be exposed.

Figure 18A:
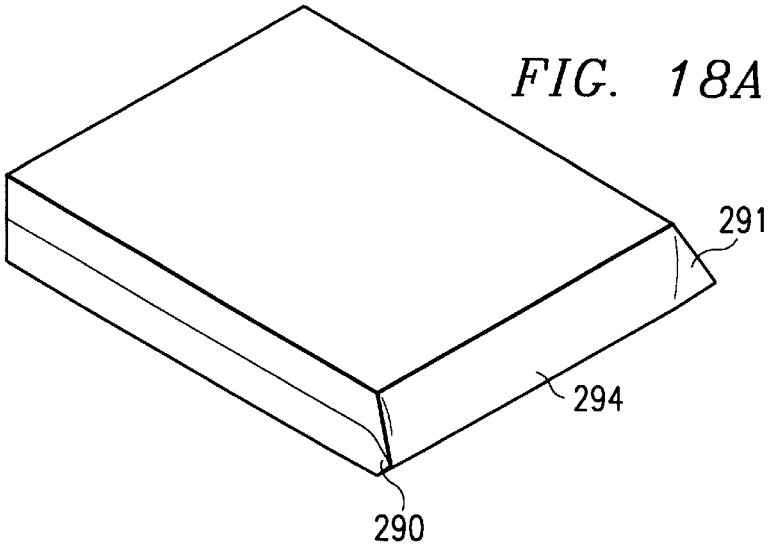
FIGS. 18A–18C illustrate forming fitted corners for a no sew pattern.
Figure 18B:
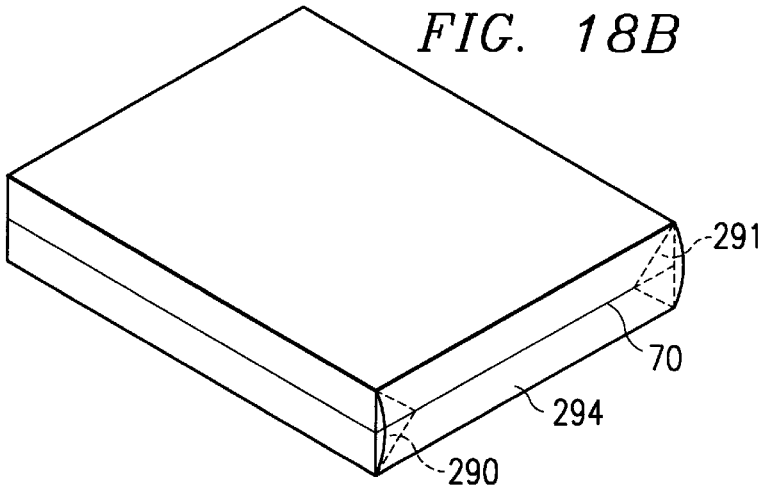
Figure 18C:
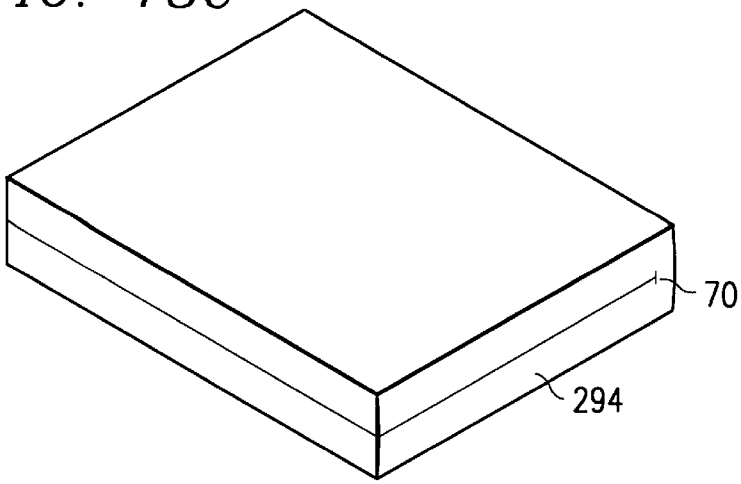

A box may then be inserted as shown in FIG. 18A, with excess cloth appearing at the bottom corners. In the preferred mode of this embodiment, this cloth is folded between the bottom seam 70 and the box, and sealed with a drop of hot glue, as shown in FIG. 18C. Folding the excess cloth between the bottom seam and the box and application of a drop of hot glue will cause a fitted corner to appear.

Although the invention has been particularly shown and described by the foregoing detailed description, it will be understood by those skilled in the art that various other changes in form and detail may be made without departing from the spirit and scope of the invention.

What is claimed is:

1. A cloth box sleeve comprising:

a) a single piece of fabric with a top edge, first and second side edges and a bottom edge, the fabric piece also having a fold line and folded along the fold line, each side edge having an upper and lower portion separated by the fold line;

b) a half cut along both side edges and adjacent the fold line;

c) a first seam fastening the upper and lower halves of the first side edge together;

d) a second seam fastening the upper and lower halves of the second side edge together;

e) an opening dimensioned to receive a box;

f) a first flap along the top edge;

g) a second flap along the bottom edge; and h) a closure adjacent to the first and second flaps for sealing the cloth box sleeve.

2. The cloth box sleeve of claim 1 wherein the closure further comprises first and second closure halves fixed to the first and second flaps.

3. The cloth box sleeve of claim 2 wherein the first and second closure halves are hook and loop type fasteners.

4. The cloth box sleeve of claim 1 wherein the closure is a drawstring.

5. The cloth box sleeve of claim 2 wherein the first and second closure halves are male and female type snap fasteners.

6. The cloth box sleeve of claim 1 wherein the two side edges and the bottom edge further comprise a seam allowance.

7. The cloth box sleeve of claim 1 wherein the two side edges are fastened using glue.

8. The cloth box sleeve of claim 1 wherein the bottom edge is fastened using heat bond hem tape.

9. A cloth box sleeve comprising:

a. a single piece of fabric with a top edge, first and second side edges and a bottom edge, the fabric piece also having a seamless fold line and folded along the fold line;

b. a quarter cut adjacent both side edges and the bottom edge;

c. a half cut along the bottom edge between the side edges adjacent the seamless fold line;

d. a first seam fastening the two side edges together;

e. a second seam along the bottom edge;

f. an opening dimensioned to receive a box;

g. upper and lower flaps along the top edge;

h. a first closure half fixed to the upper flap; and i. a second closure half fixed to the lower flap.

10. The cloth box sleeve of claim 9 wherein the first and second closure halves are hook and loop type fasteners.

11. The cloth box sleeve of claim 9 wherein the first and second closure halves are male and female type snap fasteners.

12. The cloth box sleeve of claim 9 wherein the two side edges and the bottom edge further comprise a seam allowance.

13. The cloth box sleeve of claim 9 wherein the two side edges are fastened using a straight stitch.

14. The cloth box sleeve of claim 9 wherein the bottom edge is fastened using a straight stitch.

15. The cloth box sleeve of claim 9, wherein the first closure half, and the second closure half, are formed on opposite sides of the single piece of fabric.

16. A cloth box sleeve for wrapping a box, the box having a length, a width, and a depth, the cloth box sleeve comprising:

a. a single piece of fabric with a top edge, first and second side edges and a bottom edge, the side edges having a side seam allowance, the fabric piece also having a seamless fold line and folded along the seamless fold line, the fabric piece also having a length, a width and a depth;

b. a quarter cut adjacent both side edges and the bottom edge, each quarter cut having a length and a width approximately equal to ((the depth of the box)/2) −0.25"+the side seam allowance;

c. a half cut along the bottom edge between the side edges adjacent the seamless fold line;

d. a first seam fastening the two side edges together;

e. a second seam along the bottom edge;

f. an opening dimensioned to receive a box;

g. upper and lower flaps along the top edge; and h. a closure adjacent the upper and lower flaps for sealing the cloth box sleeve.

17. The cloth box sleeve of claim 16 wherein the length of the fabric piece is approximately equal to twice the side seam allowance plus twice the depth of the box plus twice the width of the box plus 2.15 inches.

18. The cloth box sleeve of claim 16 wherein the closure further comprises first and second closures halves fixed to the upper and lower flaps and wherein the first and second closure halves are hook and loop type fasteners.

19. The cloth box sleeve of claim 18 wherein the hook and loop type fasteners have a width approximately equal to w−2d+0.25, where w=the width of the box; and d=the depth of the box.

20. The cloth box sleeve of claim 18 wherein the loop material is displaced from the top edge by a distance, the distance approximately equal to (0.5"+the top seam allowance) and the hook material is displaced from the top edge by a distance approximately equal to (the depth of the box−1.25"+the top seam allowance).

21. The cloth box sleeve of claim 16 wherein the half cut has a width approximately 0.5 inches less than the depth of the box.

22. A cloth box sleeve surrounding a box, the box having a length, a width, and a depth, the cloth box sleeve comprising:

a. a single piece of fabric with a top edge, first and second side edges and a bottom edge, the fabric piece also having a seamless fold line and folded along the fold line;

b. a quarter cut adjacent both side edges and the bottom edge;

c. a half cut along the bottom edge between the side edges adjacent the seamless fold line, the half cut having a width approximately 0.5 inches less than the depth of the box;

d. a first seam fastening the two side edges together;

e. a second seam along the bottom edge;

f. an opening dimensioned to receive a box;

g. upper and lower flaps along the top edge; and h. a closure adjacent the upper and lower flaps for sealing the cloth box sleeve.

23. The cloth box sleeve of claim 22 wherein the closure further comprises first and second closure halves fixed to the upper and lower flaps.

24. The cloth box sleeve of claim 22 wherein the closure is a drawstring.

25. The cloth box sleeve of claim 22 wherein the two side edges and the bottom edge further comprise a side seam allowance.

26. The cloth box sleeve of claim 22 wherein the side edges have a side seam allowance and wherein each quarter cut has a length and a width approximately equal to ((the depth of the box)/2)−0.25"+the side seam allowance.

27. The cloth box sleeve of claim 23, wherein the first closure half and the second closure half are formed on opposite sides of the single piece of fabric.

* * * * *